US006553908B1

(12) United States Patent
Richards et al.

(10) Patent No.: US 6,553,908 B1
(45) Date of Patent: Apr. 29, 2003

(54) WEB FANOUT CONTROL SYSTEM

(75) Inventors: John Sheridan Richards, Barrington, NH (US); Charles Henry Dufour, Durham, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/675,494

(22) Filed: Sep. 29, 2000

(51) Int. Cl.[7] ..... B41F 13/24
(52) U.S. Cl. ..... 101/248; 101/220; 101/486
(58) Field of Search ..... 101/216, 485, 101/486, 136, 137, 138, 178, 179, 180, 181, 219, 220, 248

(56) References Cited

U.S. PATENT DOCUMENTS

| | | | | |
|---|---|---|---|---|
| 4,207,815 A | | 6/1980 | Watanabe | 101/248 |
| 5,284,090 A | * | 2/1994 | Okamura et al. | 101/248 |
| 5,365,847 A | | 11/1994 | Pers | 101/248 |
| 5,383,393 A | | 1/1995 | Ueda et al. | 101/220 |
| 6,021,713 A | * | 2/2000 | Glockner et al. | 101/211 |

FOREIGN PATENT DOCUMENTS

| | | |
|---|---|---|
| JP | 3140245 | 6/1991 |
| JP | 2000954 | 1/2000 |

* cited by examiner

*Primary Examiner*—Ren Yan
(74) *Attorney, Agent, or Firm*—Davidson, Davidson & Kappel, LLC

(57) ABSTRACT

A printing cylinder has a first rotatable section having a central image area on the surface, and a first and second end. A first shell is disposed circumferentially about the first end, and a second shell is disposed circumferentially about the second end, the first and second shells having image areas on the surface and movable axially with respect to the central image area. Also provided is a printing press comprising a first sensor for detecting register marks, a second sensor for detecting fanout, and a rotatable cylinder with a first section axially adjustable with respect to a second section. A method for correcting fanout in a web printing press includes sensing register marks to provide overall circumferential and/or lateral register adjustments of a printing cylinder, sensing a section of the web other than the register marks to provide fanout information, and changing a lateral position of a first part of the printing cylinder with respect to a second part of the printing cylinder.

10 Claims, 3 Drawing Sheets

WEB FANOUT CONTROL SYSTEM

BACKGROUND OF THE INVENTION

1. Field of the Invention

The present invention relates generally to web printing presses and more particularly to a method and device for minimizing the effects of web fanout.

2. Background Information

A lithographic web printing press prints typically prints four colors on a web of material such as paper. As the web passes through blanket cylinder of the printing units, it becomes moist, which can lead to an expansion of the web. The expansion of the web in the axial direction of the printing cylinders is known as web fanout. If fanout occurs, the print or images on the web thus expand slightly as the web passes the first printing unit. The second printing unit needs to be properly registered with respect to the web images or print, so that, for example, a second color is applied as desired over an image already printed by the first printing unit.

Because the image printed by the first printing unit is subjected to fanout, the second or subsequent printing units may not be properly registered, which can lead to misregister of the image.

For some printing applications, multi-plate plate cylinders are used. These plate cylinders have a plurality of axially-spaced printing plates. For proper register of each printing plate, the plates may be movable independently of one another.

U.S. Pat. No. 4,207,815 purports to disclose a two-plate plate cylinder. One plate fits on a large diameter portion and another plate fits on a tube rotatable and axially movable with respect to the large diameter portion. The tube is fastened to a stepped shaft. Helical gearing is provided to set the axial and circumferential register of the plates. This arrangement requires a complicated, double-diameter plate cylinder and complicated gearing, as well as only being applicable to a two-plate configuration.

The device of the '815 patent also has the disadvantage that no sensors appear to be present to read the different sections of the web, e.g., the front and back of the web. The device also has the disadvantage that a complex helical gear mechanism controls the circumferential and lateral displacement of the shell, thus, the device is more difficult and time consuming to repair.

U.S. Pat. No. 5,383,393 purports to disclose a multicolor lithographic rotary press comprising a plurality of printing sections arranged along a traveling line of a paper web, a plurality of register adjusting means, a paper stretching means, and a plurality of width adjusting means. Each of the printing sections further includes at least one divided plate cylinder, each divided section of which is independently moved in the axial direction and/or circumferential direction. The device of the '393 patent further discloses a register adjusting means mechanically connected to each of the divided plate cylinders in the printing sections, and includes an adjusting mechanism for actuating the divided sections in response to the control unit connected to a sensor for detecting the lines and images printed on the paper web by each of the printing sections.

The device of the '393 patent has the disadvantage that multiple sensors are not present to read the web at differing places, thus, determination of fanout is hampered. Furthermore, the device does not have a third shell and thus, the ability to adjust to differing fanout widths of the web is limited. The device also possesses the disadvantage that in order to compensate for fanout, the device changes the width of the web rather than the displacement of the printing plates. The change in the width of the web may result in the process not working well for all paper types. Moreover, the web width adjusting device appears complicated.

BRIEF SUMMARY OF THE INVENTION

An object of the present invention is to provide for a device and method for automatic adjustment of a web printing press by use of sensors to minimize the effects of fanout. An additional or alternative object is to provide a device and method for adjustment of a web printing press by use of a cylinder having one central portion and two axially movable shells on either side of the center portion.

The present invention provides a printing cylinder comprising:

- at least one web fanout sensor for reading a web, the fanout sensor having an output;
- a first rotatable section having a central image area on the surface, and a first and second end;
- a first shell disposed circumferentially about the first end; and
- a second shell disposed circumferentially about the second end, the first and second shells having image areas on the surface and being movable axially with respect to the central image area as a function of the web fanout sensor output.

With the first and second shells movable axially with respect to the central image area of the present invention, more precise adjustments can be made to the printing surface to minimize print defects caused by fanout of the web.

The central image area may carry one or two plates, and the shells one or two plates each.

Specifically, if web fanout is occurring, the first and second shells can be moved axially away from the central image area. While this movement will not perfectly correct the problems resulting from fanout, it can reduce the effects of fanout, especially for example when used with newspapers where a plurality of pages are positioned across the web.

Preferably, the at least one web fanout sensor includes two web fanout sensors on one surface of the web. The sensors preferably are located near edges of the web, but may be located in an unprinted area near the center of the shell.

At least one register sensor for proper overall registration of the printing cylinder preferably is also included. The at least one register sensor preferably includes two register sensors located in a center of the web, with a first register sensor on a first surface of the web and a second register sensor on a second surface of the web.

The central image area and the first and second shells may be laser-writeable. Laser writeable shells provides the advantage that a desired image can be changed without having to physically remove a portion of the shell, nor waiting for erasing and rewriting the image; thus, the press downtime can be reduced.

The central image area and the first and second shells each also may further comprise a gap to insert a printing plate. The gap has the advantage that a change to the desired image can be made by first removing the existing printing plate and then modifying and replacing the existing plate or adding a plate with a different image.

The present invention also provides a printing press comprising:

at least one first sensor for detecting register marks;

at least one second sensor for detecting fanout; and a rotatable cylinder with a first section axially adjustable with respect to a second section.

With the first and second sensors, the amount of fanout can be automatically detected and the effects compensated for by axially adjusting the first and second sections. The adjustment provides the advantage of more efficient printing.

The first sensors preferably detect register marks printed by the central image area, and the sensor fanout marks printed by the shells.

The second sensors may comprise photocell detectors or video detectors. The photocell or video detectors may allow comparison of the location of one printed image to one that had been previously printed; thus, the amount of fanout can be detected without using marks on the web. However, the use of fanout marks on the web such as cross-hairs, is preferably.

The present invention further provides a method for correcting fanout in a web printing press comprising:

sensing register marks to provide overall circumferential and/or lateral register adjustments of a printing cylinder;

sensing a section of the web other than the register marks to provide fanout information; and changing a lateral position of a first part of the printing cylinder with respect to a second part of the printing cylinder as function of the fanout information.

Preferably the first part is a shell and the second part an image area of a cylinder, the shells being moved axially.

The shells may be moved in a manner similar to that disclosed in co-owned U.S. patent application Ser. No. 09/627,639, which is hereby incorporated by reference herein.

BRIEF DESCRIPTION OF THE DRAWINGS

A preferred embodiment of the present invention is described below by reference to the following drawings, in which.

DETAILED DESCRIPTION

Figure 1:
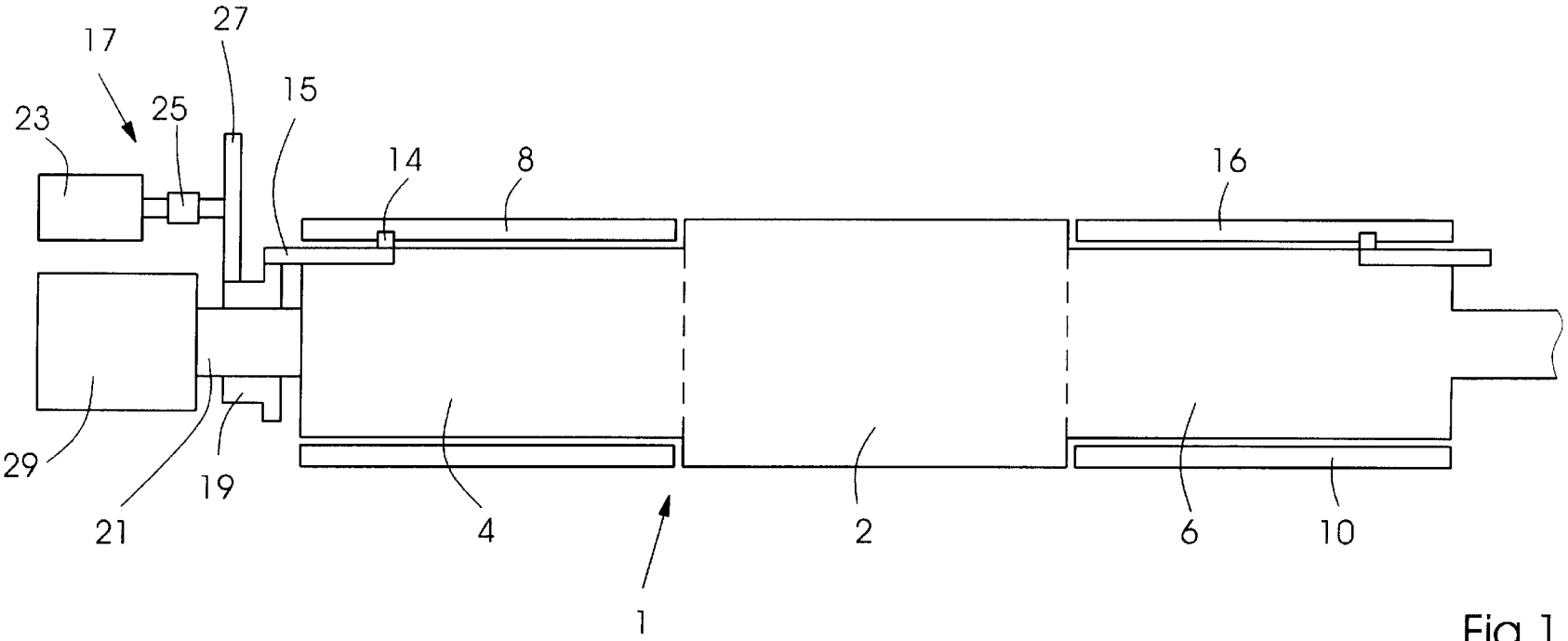
FIG. 1 is a simplified schematic cross-sectional view of the printing cylinder.

FIG. 1 is a simplified schematic view of a printing cylinder 1 having a central image area 2, a first end 4 and a second end 6. A first shell 8 is disposed circumferentially about the first end 4 and a second shell 10 is disposed circumferentially about the second end 6. First shell 8 and second shell 10 are rotationally fixed to first end 4 and second end 6, respectively, for example, through flanges 14. First shell 8 and second shell 10 however are both axially slidable with respect to the central image area 2. For example, an arm 15 rotatable and axially slidable in a groove of end 4 is in a fixed axially but rotatably movable with respect to a gear 19 which normally rotates with a drive shaft 21 of cylinder 2. Gear 19 is held threadedly on drive shaft 21 so as to be able to move axially with respect to cylinder 2 and drive shaft 21 when a fanout register device 17 for first shell 8 operates. Gear 19 is geared on an outer section to a gear 27, which is connected through a clutch 25 to an adjustment motor 23 of device 17. To move the gear 19 axially on shaft 21, clutch 25 is engaged and motor 23 thus rotates gear 27 so as to move gear 19 axially with respect to shaft 21. This movement pushes or pulls flange 14, and thus shell 8, axially with respect to central image section 2. Clutch 25 is then disengaged, so that gear 19 and shaft 21 again rotate together through the friction. Alternately, another clutch may be provided to selectively lock the gear 19 and shaft 21 together.

An overall register motor 29 can move the entire cylinder 2 axially and circumferentially in a conventional manner. When the overall register is adjusted, clutch 25 is disengaged and gear 27 can slide axially with respect to gear 19.

Second shell 10 may have a similar device to fanout register device 17.

Alternatively, the first shell 8 and second shell 10 may be axially moved by flanges as described in U.S. patent application Ser. No. 09/627,639, which is hereby incorporated by reference herein.

The rotation of the printing cylinder 2 rotates the first shell 8 and second shell 10 through the flanges 14 or through other support devices, which also stabilize the first shell 8 and second shell 10 with respect to the printing cylinder 2. The first shell 8 and second shell 10 each contain a plurality of plate insertion gaps 16 so that pre-imaged plates can be attached. Alternatively, the first shell 8 and second shell 10 could also be laser writeable.

Figure 2:
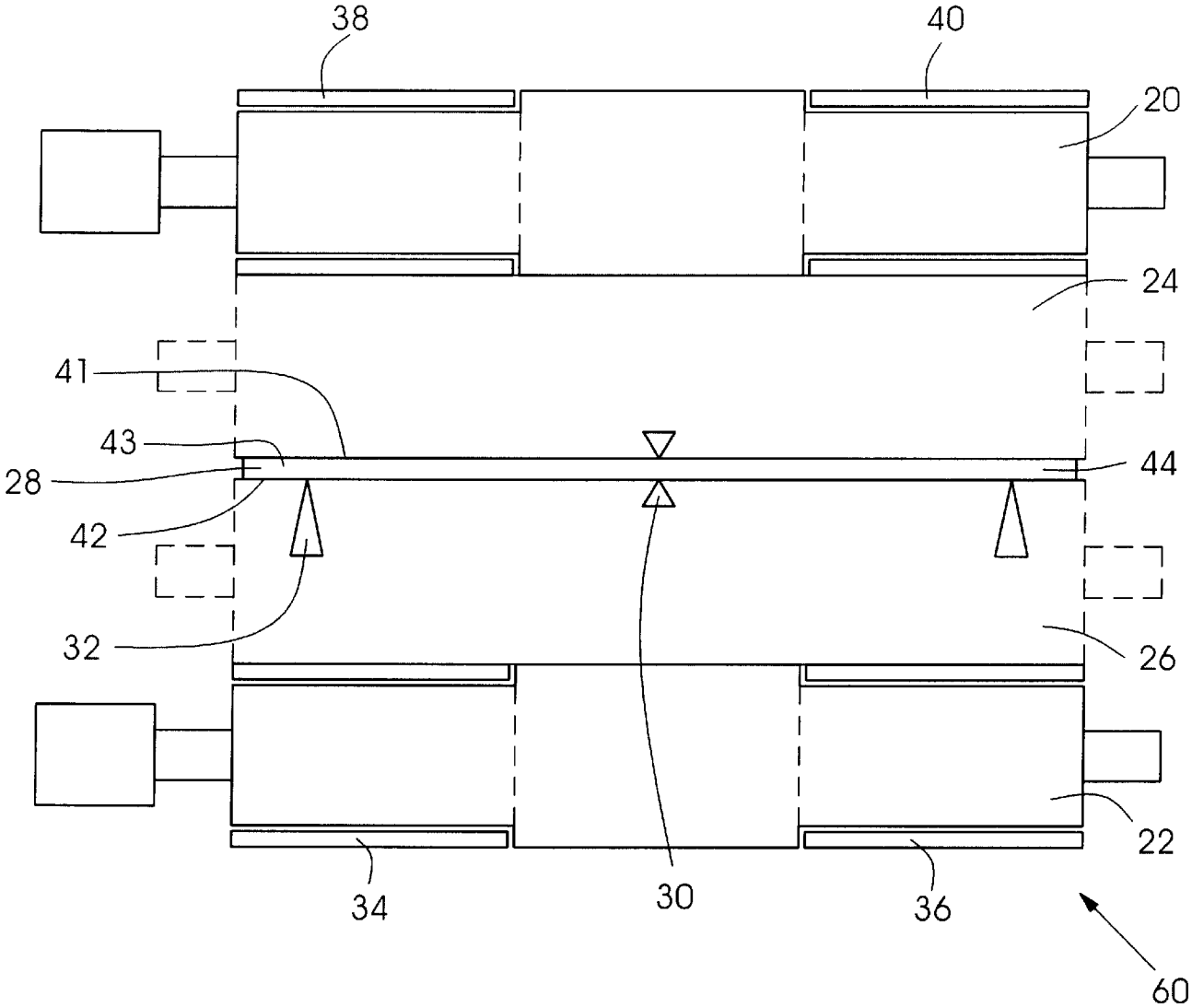
FIG. 2 shows a cross-sectional view of a printing unit of an offset printing press, which includes a first printing cylinder and a second printing cylinder.
Figure 3:
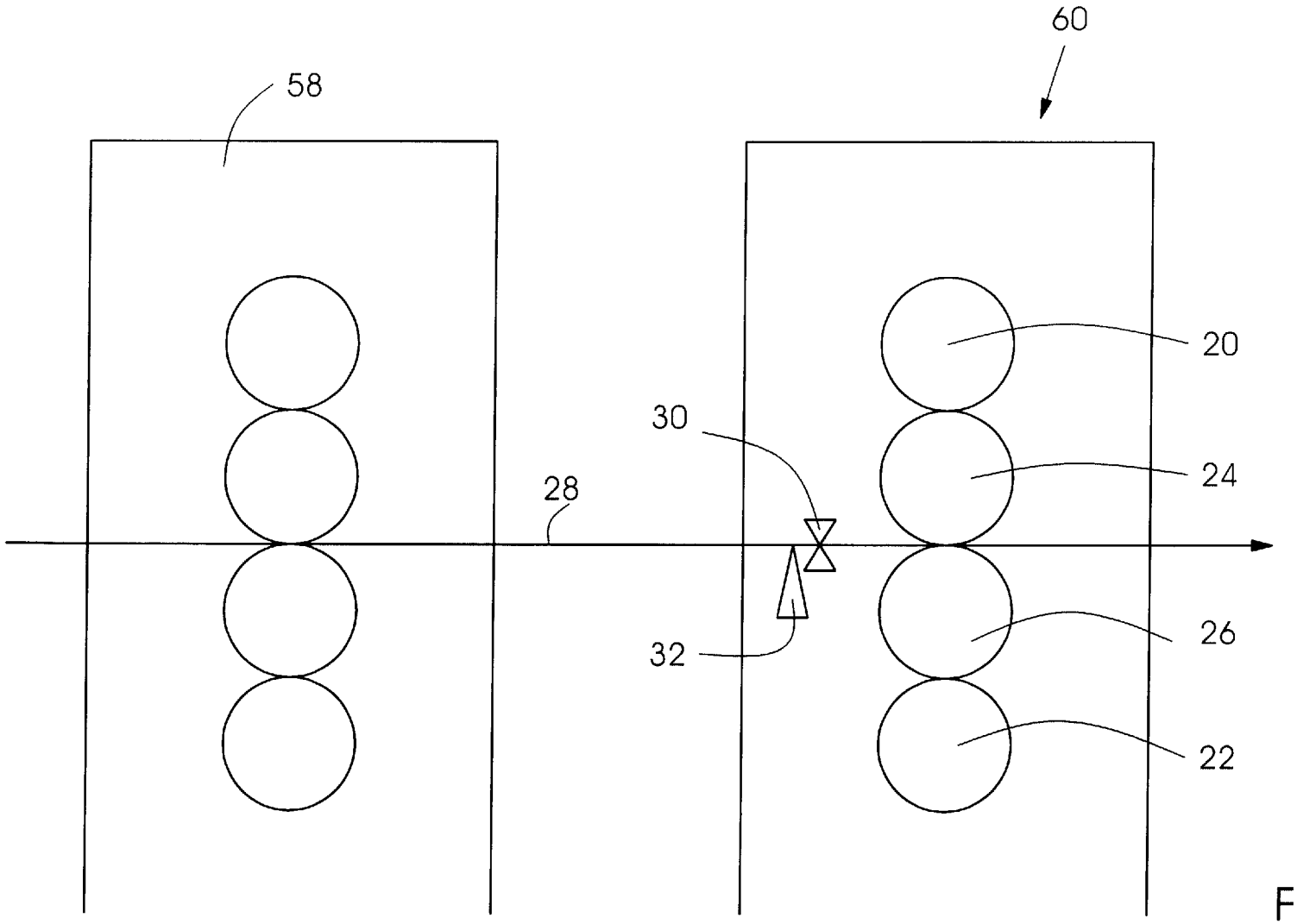
FIG. 3 shows a printing unit in side view according to the present invention.

FIGS. 2 and 3 show a printing unit 60 of an offset printing press, which also has a first printing unit 58. Printing unit 60 includes a first printing cylinder 20 and a second printing cylinder 22, each similar to the printing cylinder 2 described in FIG. 1. An image is transferred from the first printing cylinder 20 to a first blanket cylinder 24 to print a first surface 41 of a web 28. Another image is transferred from the second printing cylinder 22 to a second blanket cylinder 26 to print a second surface 42 of web 28. A plurality of first sensors 30 monitor the axial and circumferential register for the web 28 by reading marks on the web 28. A plurality of second sensors 32 read additional marks that indicate fanout of the web 28 at edge areas 43 and 44 of web. The data obtained by the first sensors 30 and second sensors 32 is used to axially move a first shell 34, a second shell 36, a third shell 38, and a fourth shell 40 to adjust the printing surface so as to minimize the printing errors caused by fanout of the web 28.

To correct fanout in a web printing press, for example the printing press as described in FIG. 3, sensors 32 provide information regarding the fanout caused by first printing unit 58. If the fanout register marks have moved outwardly due to fanout, the shells 38, 40 and 34, 36 can be moved by respective fanout register devices outwardly with respect to the central image areas in order to minimize the fanout. For example, if the fanout marks have moved 1 mm, the shells could be moved outwardly 0.5 mm. The sensors 32 can provide an automatic feedback to a controller controlling fanout register devices 17.

While present invention has been disclosed with the advantageous feature that sensors automatically controlling the register devices, an operator could also perform the fanout adjustment.

What is claimed is:

1. A printing press comprising: a web;

a first sensor for detecting register marks on the web;

a second sensor for detecting fanout of the web and having an output; and a rotatable cylinder with a first rotatable section having a first image area on an outer surface of the rotatable cylinder and having a first end, the first image area having a radius larger than the first end; and a first shell disposed circumferentially about the first end, the first shell having a second image area; and an adjustment device for axially adjusting the first shell with respect to the first rotatable section as a function of the output of the second sensor for detecting fanout of the web.

2. The printing press as recited in claim 1 wherein the first rotatable section is fixed with respect to the first end.

3. The printing press as recited in claim 1 wherein the adjustment device includes a web fanout registration device for axially adjusting the first shell with respect to the first rotatable section and an overall axial registration device for moving the first shell and the first rotatable section together axially as a function of the first sensor output.

4. The printing press as recited in claim 3 wherein the fanout registration device receives an input as a function of the output.

5. The printing press as recited in claim 1 wherein the first rotatable section is a middle section, and the cylinder has a second end, and further comprising a second shell disposed circumferentially about the second end.

6. The printing press as recited in claim 1 wherein further comprising a third sensor for detecting fanout of the web, the first sensor being located axially between the second and third sensors.

7. A method for correcting fanout in a web printing press comprising:

sensing register marks on a web to provide overall register adjustments to a printing cylinder for printing the web;

sensing a section of the web other than the register marks to provide fanout information; and changing an axial position of a first part of the printing cylinder with respect to a second part of the printing cylinder as a function of the fanout information.

8. The method as recited in claim 7 wherein the sensing of the section step includes sensing fanout marks on one surface of the web.

9. The method as recited in claim 7 wherein the changing step includes moving the first part using a fanout registration device.

10. The method as recited in claim 7 further comprising moving the first part and the second part of the cylinder together as a function of the overall register adjustments.

* * * * *